US007353685B2

(12) United States Patent
Martin et al.

(10) Patent No.: US 7,353,685 B2
(45) Date of Patent: Apr. 8, 2008

(54) APPARATUS FOR PUNCHING, STAMPING AND/OR SHAPING FLAT ELEMENTS

(75) Inventors: Peter Josef Martin, Geisenheim (DE); Steffen Polster, Hochheim (DE); Hans Grossmann, Steinheim (DE)

(73) Assignee: Tetra Laval Holdings & Finance S.A., Pully (CH)

( * ) Notice: Subject to any disclaimer, the term of this patent is extended or adjusted under 35 U.S.C. 154(b) by 229 days.

(21) Appl. No.: 10/524,483

(22) PCT Filed: Oct. 11, 2003

(86) PCT No.: PCT/EP03/11287

§ 371 (c)(1),
(2), (4) Date: Mar. 16, 2005

(87) PCT Pub. No.: WO2004/037527

PCT Pub. Date: May 6, 2004

(65) Prior Publication Data

US 2006/0021526 A1 Feb. 2, 2006

(30) Foreign Application Priority Data

Oct. 18, 2002 (DE) ..... 102 48 859
Aug. 18, 2003 (DE) ..... 103 37 864

(51) Int. Cl.
*B21J 9/18* (2006.01)
*B30B 1/02* (2006.01)

(52) U.S. Cl. ..... 72/450; 72/452.2; 72/451; 100/283

(58) Field of Classification Search ..... 72/443, 72/456, 450, 451, 452.7, 452.2, 452.8; 100/281–283, 100/83, 292; 83/628, 630
See application file for complete search history.

(56) References Cited

U.S. PATENT DOCUMENTS 3,264,886 A 8/1966 Marty (Continued)

FOREIGN PATENT DOCUMENTS

DE 19 74 429 U 12/1967

(Continued)

*Primary Examiner*—Derris H. Banks
*Assistant Examiner*—Teresa M Bonk
(74) *Attorney, Agent, or Firm*—Paul & Paul

(57) ABSTRACT

A device for punching, stamping and/or shaping flat elements (29) includes a base body (1) with a table (18) and support (26) for the flat element (29), and a base plate (17), which supports a punch (24), and which is advanced with a drive (4,5) toward the support (26) and into a working station (II), bringing the punch (24) into contact with the support (26). A large number of successive, very short, highly precise, punching strokes make punched holes or stampings. Short stop periods and short clock times are used for fast moving flat elements (29). Transfer apparatus (9, 7; 35; 43; 46) coupled between the drive (4,5) and the base plate (17) move the base plate (17) without building up pressure from a position of rest (I) The punch (24) is not in contact with the support (26), up to immediately in front of working position (II). The base plate (17) is then moved into working position (II) while producing a high pressure between the base plate (17) and the flat element (29). During further operation of the drive (4,5), the base plate (17) is returned to the position of rest (I,II) without building up pressure.

5 Claims, 10 Drawing Sheets

U.S. PATENT DOCUMENTS

Figure 1:
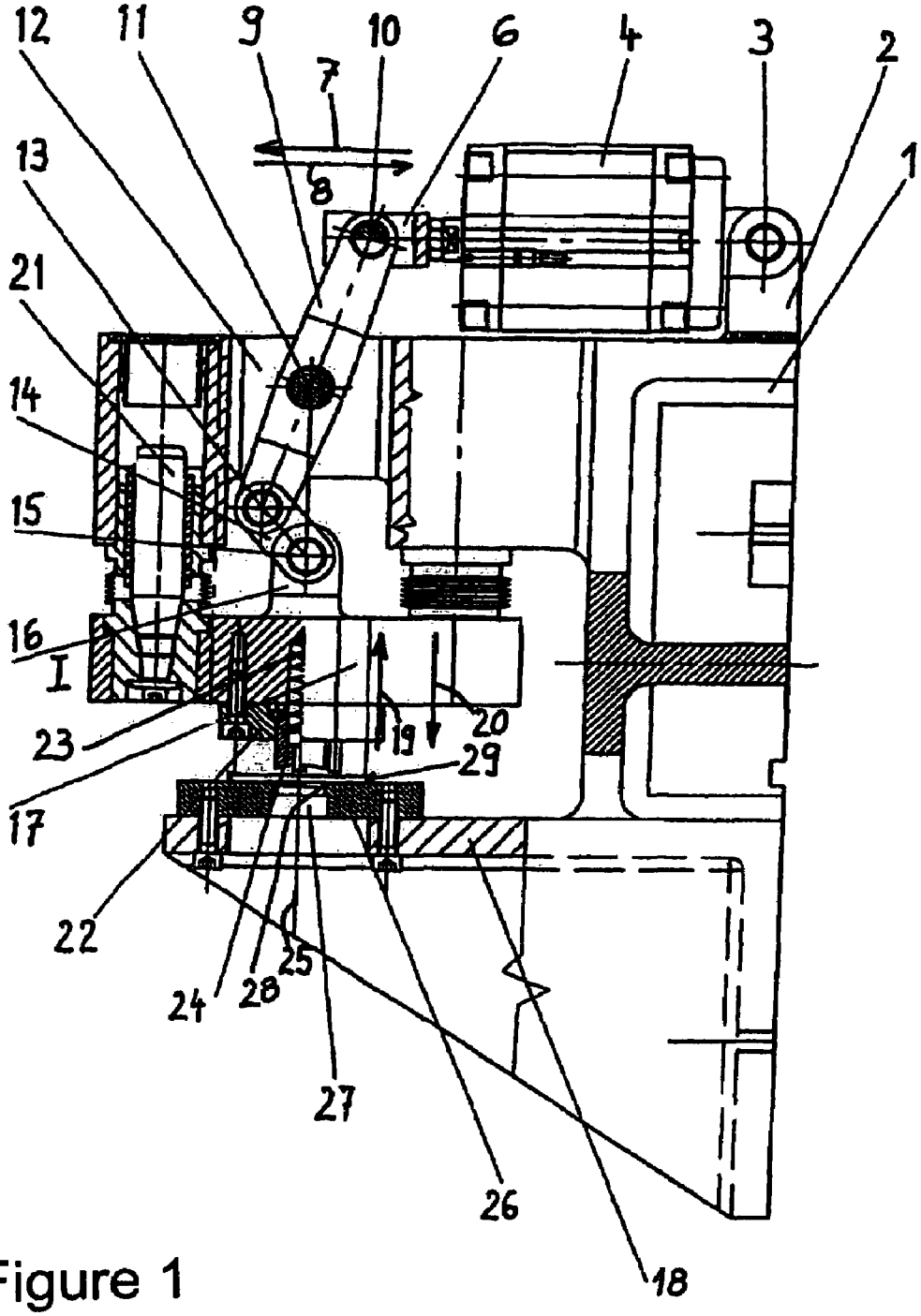

| | | | | | |
|---|---|---|---|---|---|
| 4,856,316 | A | * | 8/1989 | Slasinski | 72/451 |
| 4,959,989 | A | * | 10/1990 | Obrecht et al. | 72/450 |
| 5,253,572 | A | * | 10/1993 | Uehara et al. | 100/48 |
| 5,488,880 | A | * | 2/1996 | Sartorio | 72/454 |
| 5,544,576 | A | | 8/1996 | Kato | |
| 5,720,199 | A | * | 2/1998 | Dischler | 72/452.4 |
| 6,510,786 | B1 | | 1/2003 | Harsch | |

FOREIGN PATENT DOCUMENTS

| | | |
|---|---|---|
| DE | 25 16 526 | 10/1976 |
| DE | 41 09 796 A1 | 10/1992 |
| DE | 299 06 229 U1 | 4/1999 |

* cited by examiner

APPARATUS FOR PUNCHING, STAMPING AND/OR SHAPING FLAT ELEMENTS

The invention concerns an apparatus for punching, stamping and/or shaping flat elements comprising a base body with a table and a support for the flat element, and a base plate which supports a tool punch and which to carry out the working process can be moved by means of a drive towards the support into a working station for engagement of the tool punch with the support and away from the support.

Such apparatuses are used to punch or shape flat semi-manufactured articles such as for example plates, strips and blanks, in a continuous process. Those webs, strips, plates or blanks which are referred to as flat elements can comprise different materials, for example cardboard, lined cardboard material, multi-layer material or metal plate.

Previously known apparatuses similar to the kind set forth in the opening part of this specification are provided with a direct hydraulic or pneumatic drive having a cylinder which acts on the punching tool. The full punching force has to be applied in the punching direction, whereby a jerky or shock force situation occurs and only low cycle speeds are achieved because the retraction of the cylinder has the effect of lost time.

Other known solutions operate with a pneumatic cylinder as the drive and an integrated linear guide means, whereby, besides the disadvantages indicated, in terms of mass production, there is the further disadvantage of a shorter service life. In practice faults were in part already found to occur after 40 hours. For those reasons punching tools used hitherto act as brakes on the machines.

There are also known apparatuses with a rotating punching tool, the axis of which is parallel to the strip to be processed, in that respect transversely with respect to the direction of travel. It is also possible with those known apparatuses to effect punching without stopping the strip. During the punching operation however the speed of rotation of the punching tool and the speed of the strip to be worked must be absolutely synchronised. Such solutions are hitherto only known in configurations in which the level of precision of punching, which is required for many uses, is not achieved. In that respect there are both problems in maintaining precise positional co-ordinates of a hole and also maintaining the diameter or profile tolerances and the tolerances for implementing a cut at a right angle from above downwardly, that is to say, concerning the wall of the hole.

Therefore the object of the invention is to provide an apparatus of the kind set forth in the opening part of this specification, with which a large number of very short, highly precise punching strokes can be effected in succession for producing punched holes or stampings. The invention seeks to provide in particular when dealing with fast-moving flat elements that in that respect short stoppage times and thus short cycle times and indeed working strokes which are as short as possible are achieved.

In accordance with the invention, that object is attained in that coupled between the drive and the base plate are transmission means which move the base plate from a rest position in which the tool punch is out of engagement with the support, substantially without a pressure build-up, to shortly before the working position, and then move it into the working position over a short distance while producing a high pressure between the base plate and the flat element and upon further activity of the drive move the base plate into the rest position again over regions substantially without a pressure build-up. The apparatus according to the invention can be used to punch holes and/or apply stampings in flat semi-manufactured products. The flat semi-manufactured products are here referred to generally as flat elements.

The novel apparatus can be used in particular in a continuous process to punch holes economically into those flat materials and in that respect with a very high degree of precision or to effect similarly economical and precise stampings in such materials. In accordance with the invention, in contrast to the state of the art, very short stoppage times, and a short working procedure with a short stroke movement are implemented, so that reference is made to very short cycle times.

The invention relies on the basic idea that the tool punch which is mounted on the base plate is to be driven in accordance with a given pattern of motion. This involves the motion ultimately of the tool punch towards and away from the support which holds the flat element. In the case of punching a hole can be provided in the support so that the tool punch punches through the flat element into that hole in the support. Similar considerations apply in regard to stamping. In accordance with the invention the pattern of motions itself should follow the principle of moving the tool punch (and therewith the base plate) towards and away from the working position without a substantial build-up of pressure, a greater speed of movement being provided here. When in contrast the tool punch passes into the working position, then the movement should take place only over a short distance, but in return producing a high pressure. That pattern of movements is achieved by way of an interposed transmission means between the drive and the base plate. The tool punch is advantageously always held absolutely parallel to the plane of the flat element over the entire cutting depth or stamping depth, in that working procedure.

In accordance with the invention that advantageously provides a flat, gentle, sliding and non-jerky development of forces. The invention makes it possible to avoid those impacts and jerks which occur with conventional apparatuses when the full punching force is applied in a linear direction.

In the one embodiment it is provided in accordance with the invention that the axis of the drive is perpendicular to the axis of the tool punch; whereas in another embodiment the axis of the drive is parallel to the axis of the tool punch. It is possible to envisage various design configurations for each of those two embodiments. Thus for example the drive can be a pressure-producing means with a cylinder and a piston, the piston movement of which, in one embodiment, is parallel to the direction of conveying movement of the flat element. As the axis of the tool punch is arranged perpendicularly to the plane of the flat element, the drive axis is then perpendicular to the axis of the tool punch. Among the numerous other embodiments, it is also possible to envisage a configuration in which the drive is a motor, the axis of rotation of which is parallel to that of the tool punch; in a specific embodiment, the axes even coincide. When using the basic idea according to the invention, the man skilled in the art will select the appropriate structure, depending on the respective advantages thereby presented to him.

If consideration is given to an embodiment of that above-mentioned solution, in which the axis of the drive is parallel to the axis of the tool punch, it can then be provided in accordance with the invention that the transmission means have at least one rotary lever pivotable about a stationary pivot point. Such a structure is robust and precise.

Another preferred embodiment in which the axis of the drive is parallel to the axis of the tool punch is characterised in that the linear direction of movement of the base plate is predetermined by a column guide means operative between the base body and the base plate and that the drive has a drive means which oscillates linearly in its axis (of the drive) which is perpendicular thereto. Such an oscillating drive means can be for example a pneumatic or hydraulic cylinder with a reciprocating piston. The piston rod can be viewed as such a linear, oscillating drive means, through which the axis of the drive can be imagined as being placed. The axis of the tool punch then again extends perpendicularly thereto. The column guide means permits precise angular guidance and exact working, for example punching or stamping.

In accordance with the invention a further development of such an embodiment provides that a long rotary lever is pivotable about a pivot point fixed to the base body and is coupled at its one end by way of an elbow lever pivot to one end of a short pivot lever whose other end is coupled to the base plate by way of an elbow lever mounting. That mechanical structure provides a dead center point in a given position of the long rotary lever and the short pivot lever, and as a result, having regard to the above-indicated basic idea of the invention, that arrangement affords very great force effects in the proximity of that dead center point. Inter alia that is achieved by the long travel of the linearly oscillating drive means, with the advantage of a short travel in respect of the working tool, for example the tool punch. In that respect the drive can have a pneumatic cylinder or a hydraulic cylinder. The long rotary lever, coupled to the short pivot lever (elbow lever principle) can be considered as a kinematic system which acts in such a way that the base plate provides for the implementation of a respective working operation, for example a punching operation, both in the direction of rotation of the long rotary lever in the counter-clockwise direction and also in the direction of rotation in the clockwise direction. The principle according to the invention can be clearly implemented here, more specifically, that firstly, with a large fast stroke movement and a low level of force, the tool punch is moved to a position close to the flat element and then, with a short travel distance and a high force, the working operation is carried out; whereupon, once again with a large fast stroke movement and a low level of force, the tool punch is removed from or moved away from the flat element.

In a further advantageous configuration of the invention mounted rotatably to the base plate is at least one roller which is guided in such a way as to run against at least one cam which at at least one location has a configuration with a component in parallel relationship with the axis of the tool punch. If the cam did not have any location with such a component in parallel relationship with the axis of the tool punch, then the roller which runs against the cam, upon the movement of the cam, relative to the roller, could not move either the roller or the base plate connected thereto. If, to carry out the principle according to the invention, a short vigorous stroke movement in the direction of the axis of the tool punch is desired, then the above-mentioned component of movement should be in parallel relationship with the axis of the tool at the location in question of the cam. As it is possible to produce any desired cam, it is readily possible for the roller with the base plate to be guided at any desired moment with a high force over a short travel distance in order precisely to achieve the desired working effect. The above-mentioned cam can be provided on an oscillating or rotating part of the machine, which is stationary or movable, insofar as only a relative movement is possible between the roller and the cam.

It is further desirable in accordance with the invention if the cam is provided at the periphery of a rotatably driven cylinder as the transmission means. The cam can be incorporated in the form of a groove in such a cylinder which can be rotated in a controlled fashion. Other axial raised portions on the cylinder however are also possible. At any event, mounted rotatably to a holder of the base plate are rollers which run against such a cam, for example in a groove at the periphery of the rotatable cylinder, in such a way that, depending on the respective configuration of the cam, the base plate can be moved oscillatingly by way of the holder in the direction of the axis of the cylinder which is then for example disposed in the direction of the axis of the tool punch. In that respect, in a preferred embodiment of the invention, the cylinder can also be provided with a coaxially fixed pinion which is driven by meshing engagement with an oscillatingly movable rack.

Another embodiment is characterised in that the cam is provided on the rotary lever.

Another advantageous configuration of the invention provides, similarly to the case with the rack, that the movement of the roller is along a rectilinear cam bar, namely in such a way that, in accordance with the invention, the cam is arranged on an oscillatingly movable, rectilinear cam bar.

The drive either of the above-mentioned cylinder with the groove or the above-mentioned pinion can be for example a rotary motor, preferably a servo motor. Along a full periphery of the cylinder or along the rack, the cam can have a plurality of the above-mentioned particular locations with the configuration having a component parallel to the axis of the tool punch, so that, in one revolution, the tool punch comes into engagement at least once with the support and the flat element, for example to punch it or stamp it, and possibly even between twice and four times per overall length or per full revolution.

A further advantageous configuration of the invention is characterised in that the axis of the rotary lever extends perpendicularly to the axis of the tool punch which is movable by way of the base plate in a translatory and rotational fashion relative to the rotary lever. In this embodiment the rotary lever is a carrier for the tool punch, possibly also the carrier for two tool punches. The axis of that rotary lever is parallel to the plane of the flat element which is to be worked. In this embodiment, the levers and/or the cam disks form a kinematic system and always hold the tool punch over the entire stroke movement of the punch, that is to say when moving towards the support and also upon retraction therefrom, in absolutely parallel relationship with the flat element. In this embodiment it is desirable for a counterpart tool of a similar structure to be arranged under the flat element or on the opposite side. In the case of this counterpart tool, the rotary lever, the tool carrier, also holds the tool punch in absolutely parallel relationship with the flat element. After the tool punch is lifted off the flat element the rotary speed of the rotary lever can be so established by control of the drive motor that the tool punch comes into engagement again only when the correct distance has been covered from one working location to another working location (in a stamping procedure for example from one hole to another) by a moving flat element.

The flat element can more specifically also be imagined as a moving strip of material, in which case working operations can be carried out on that strip in a continuous procedure in an economical and highly precise fashion. That is achieved with the measures according to the invention by virtue of the very short stoppage times and the equally short working process with a short stroke movement. The new apparatus permits extremely short cycle times and also makes it possible to work with strips or webs as flat semi-manufactured products in a continuous process. That also applies in regard to strips and webs which move at very high speed.

Longer service lives are achieved with the apparatus according to the invention for those fast-moving webs because only one single forward or reverse stroke movement of the base plate is required for each working operation. In addition higher cycle speeds are achieved, in particular because for example in the case of the embodiment with the long rotary lever and the short pivot lever with the drive, whose axis is perpendicular to that of the tool punch, both the forward stroke movement and also the return stroke movement are used for a respective working operation. With the embodiment which has the servo motor as the drive, the advantageously high cycle speed is achieved because a respective revolution of the servo motor can be converted into one and preferably even a plurality of punching cycles.

With all the above-specified advantages, the invention also surprisingly affords a high level of precision in regard to accuracy of the positional co-ordinates, the hole profile tolerances and the hole wall tolerances in the case of punching (and similarly when stamping or shaping).

Figure 2:
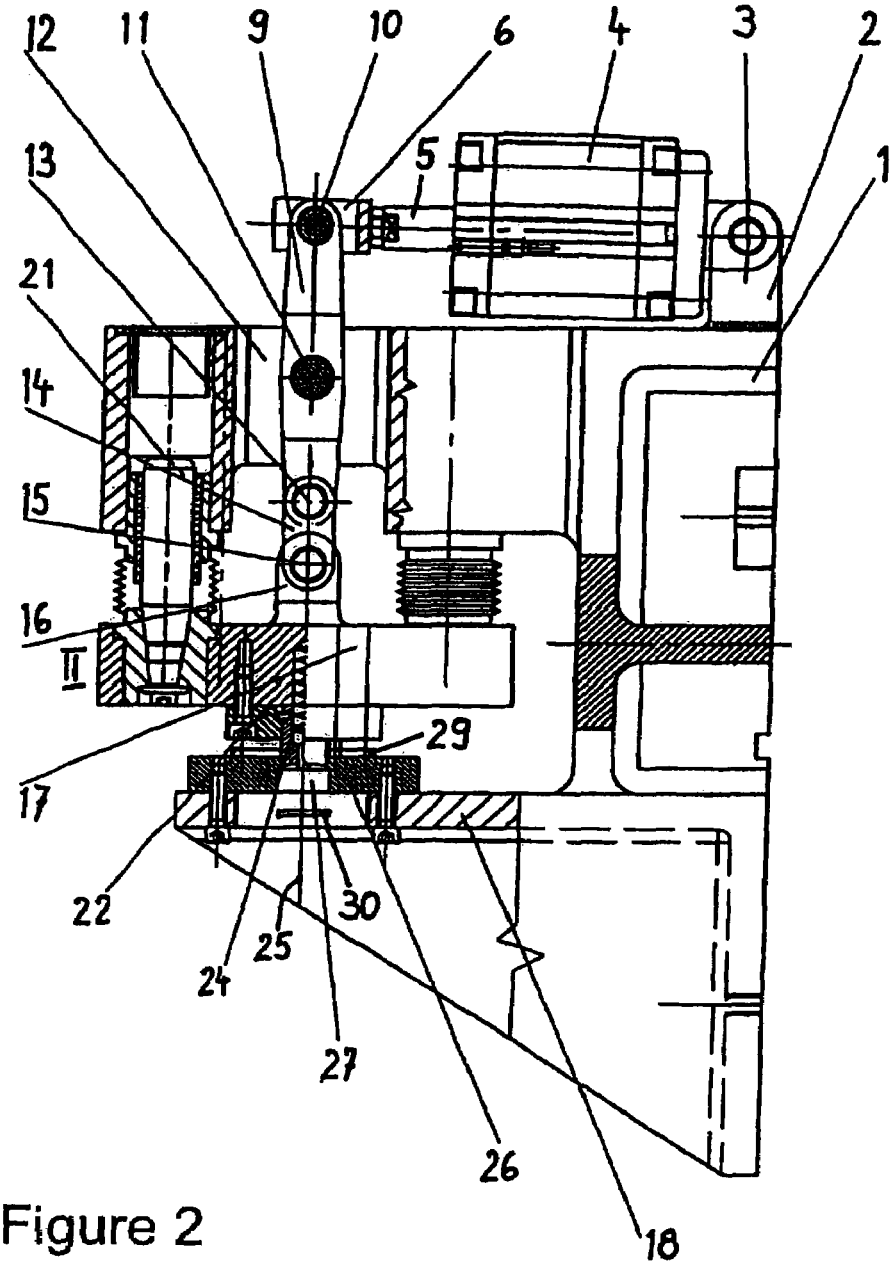
Figure 3:
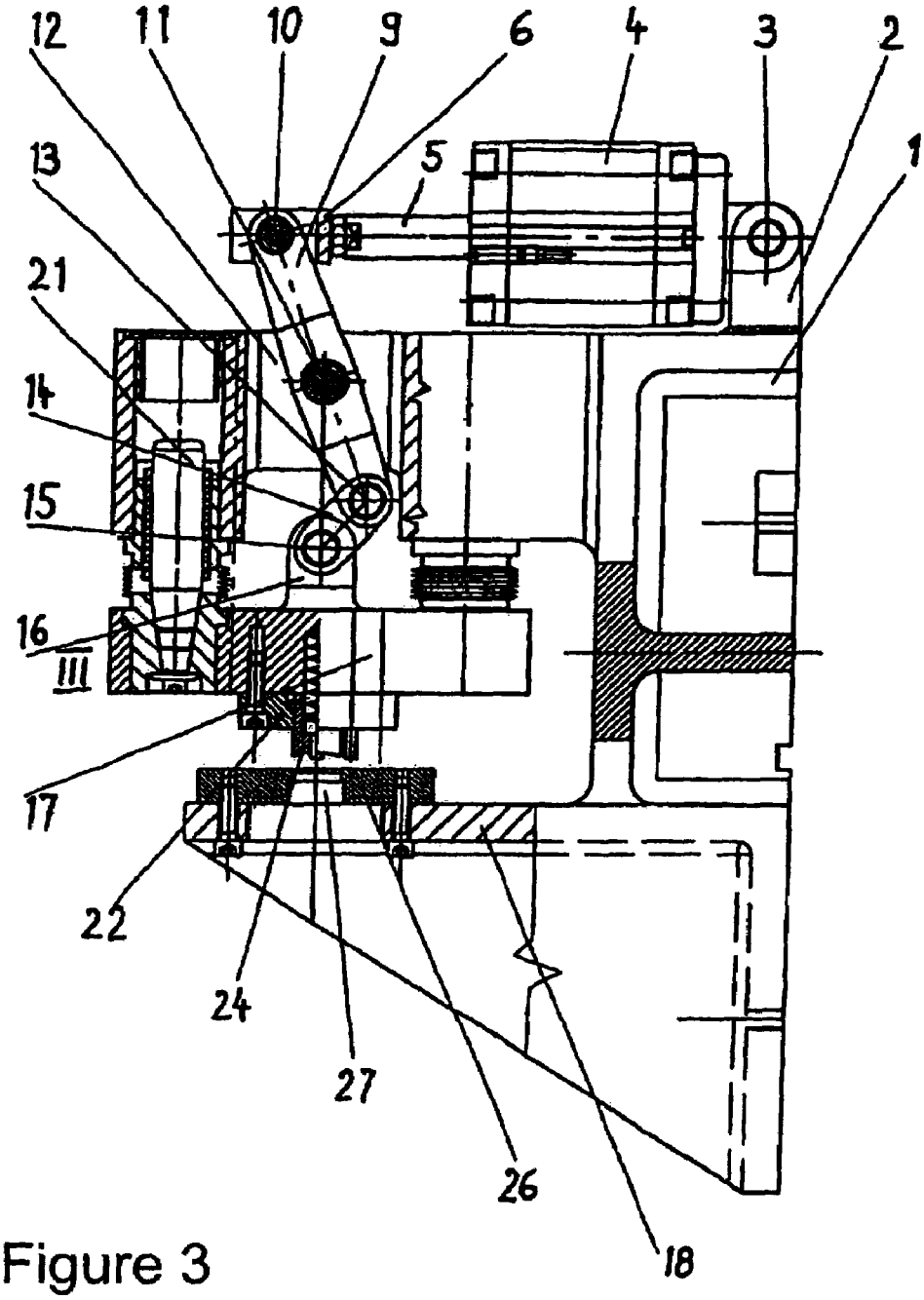
Figure 4:
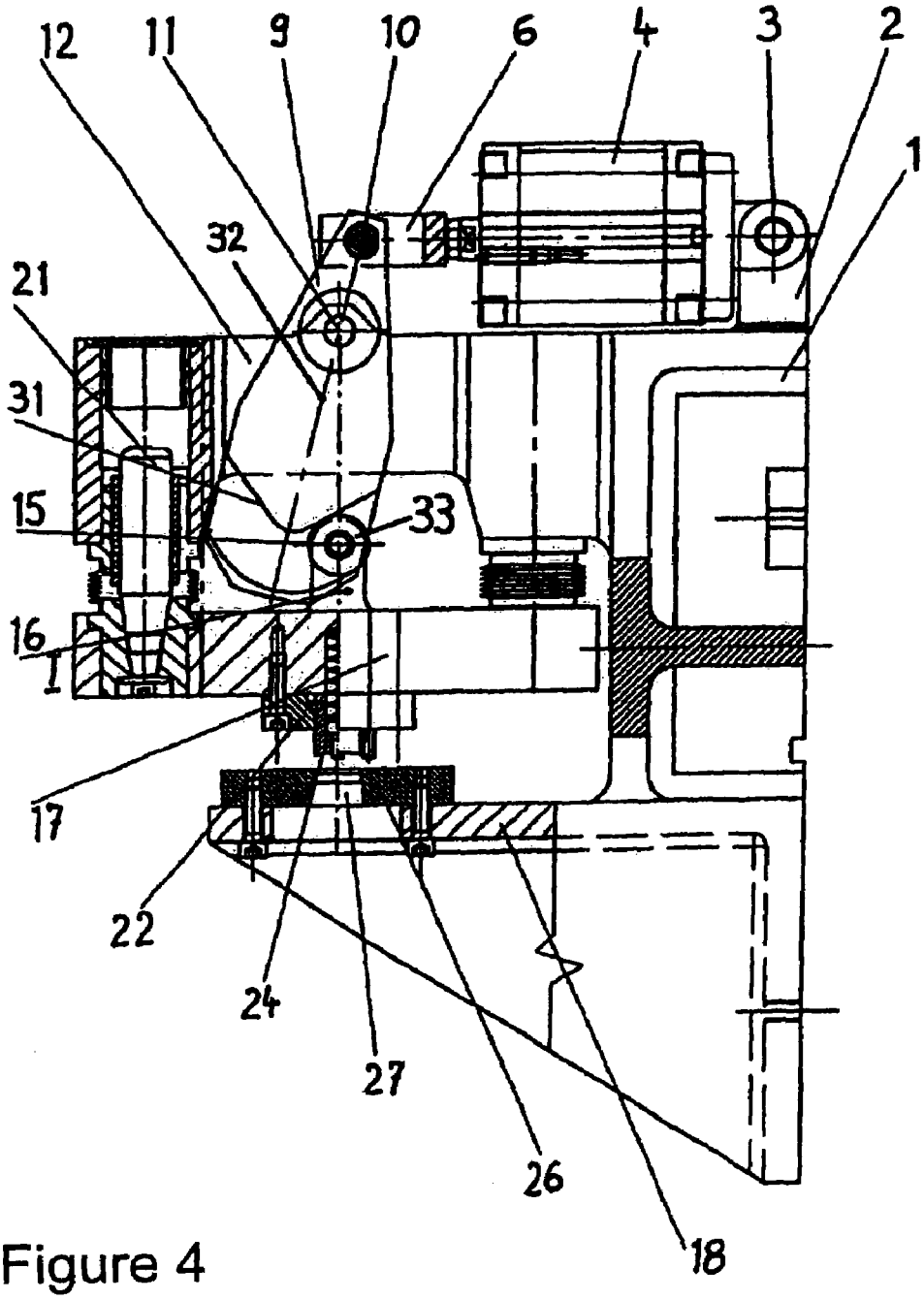
Figure 5:
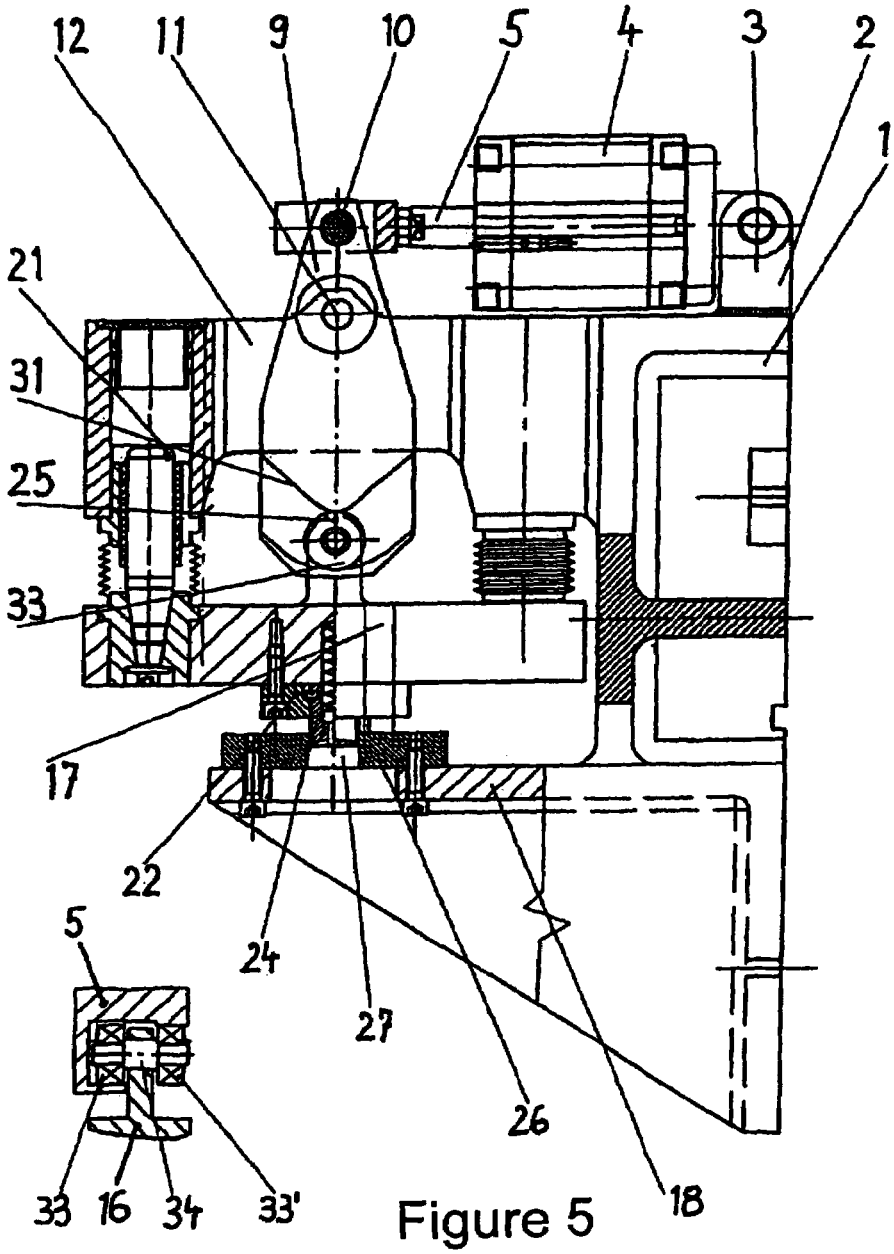
Figure 6:
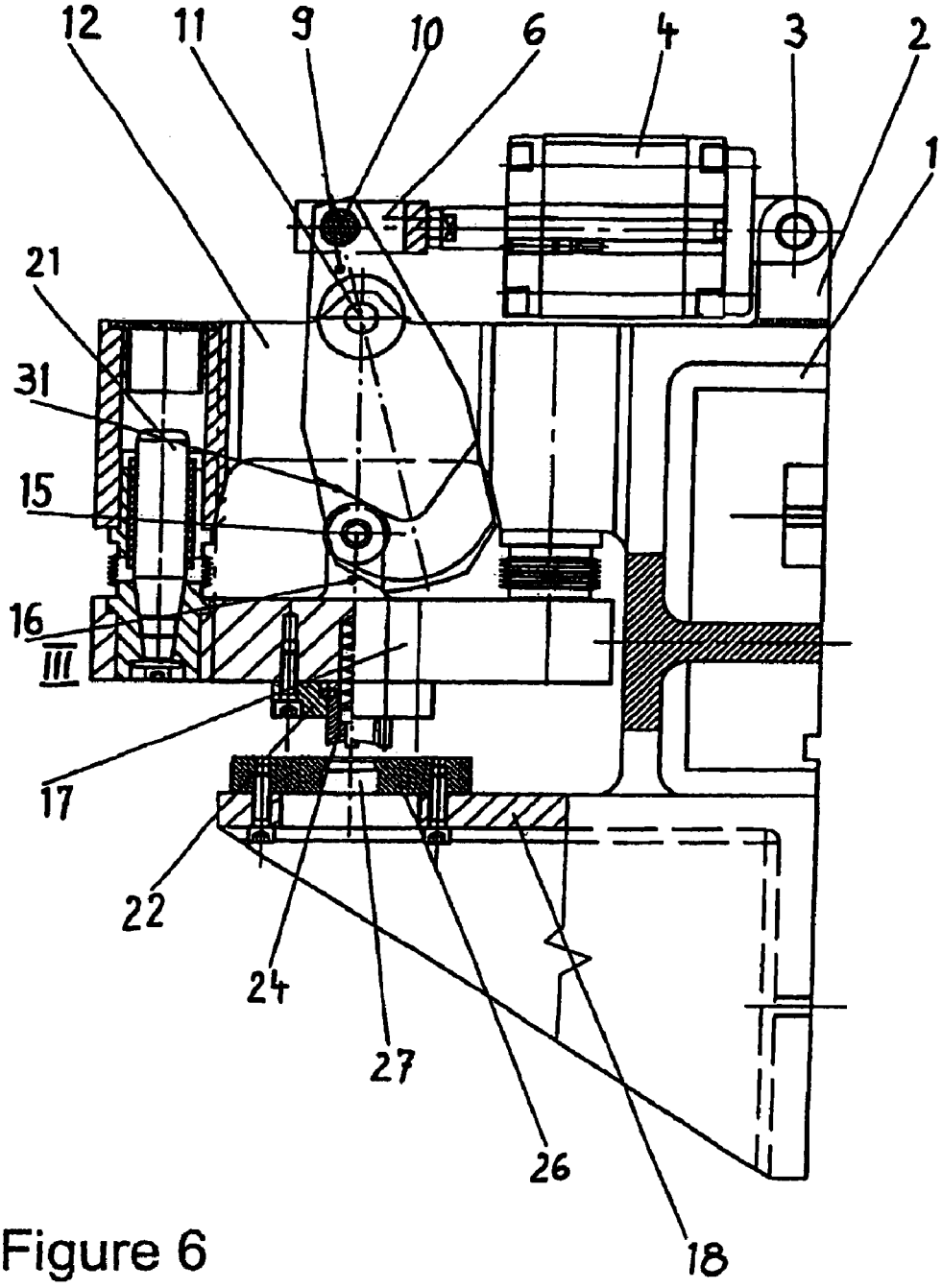
Figure 7:
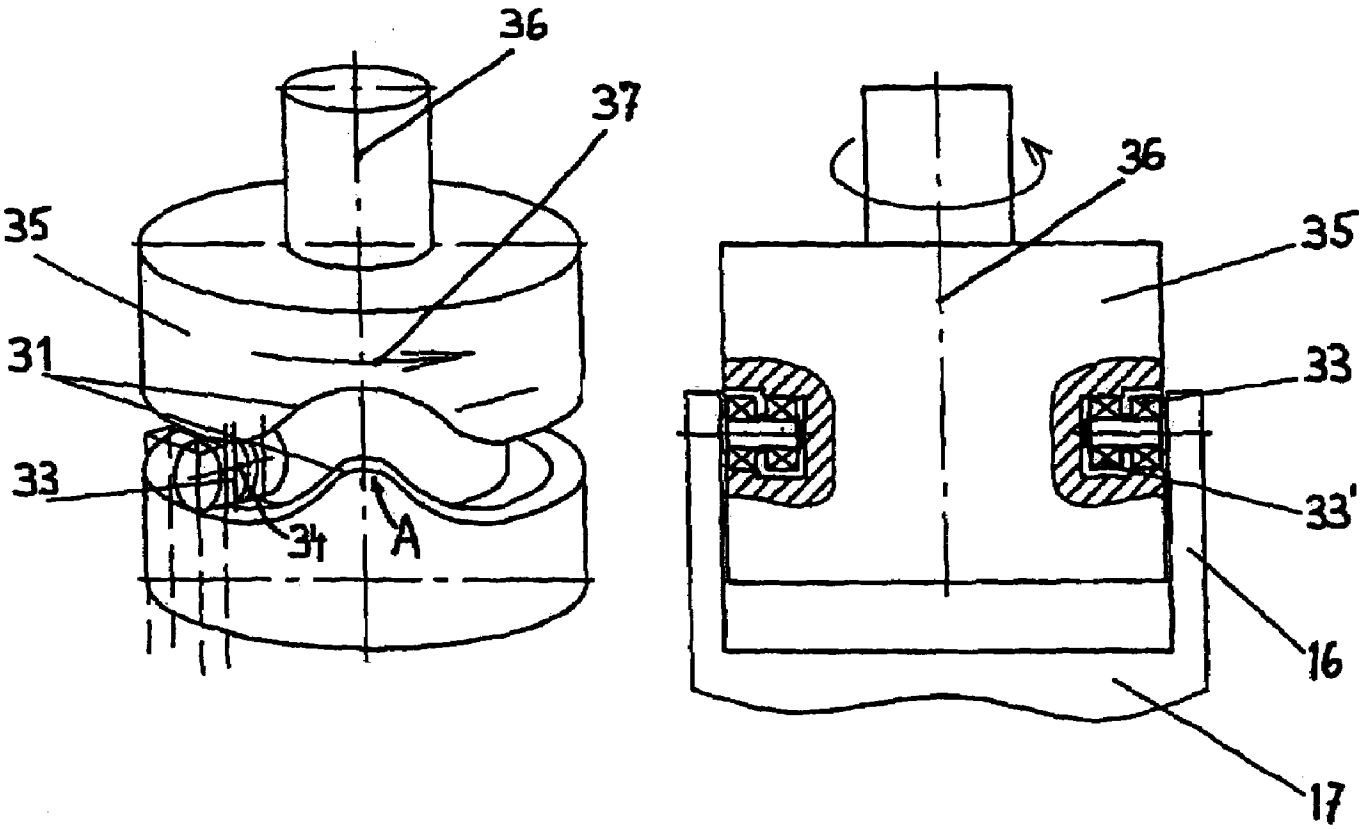
Figure 8:
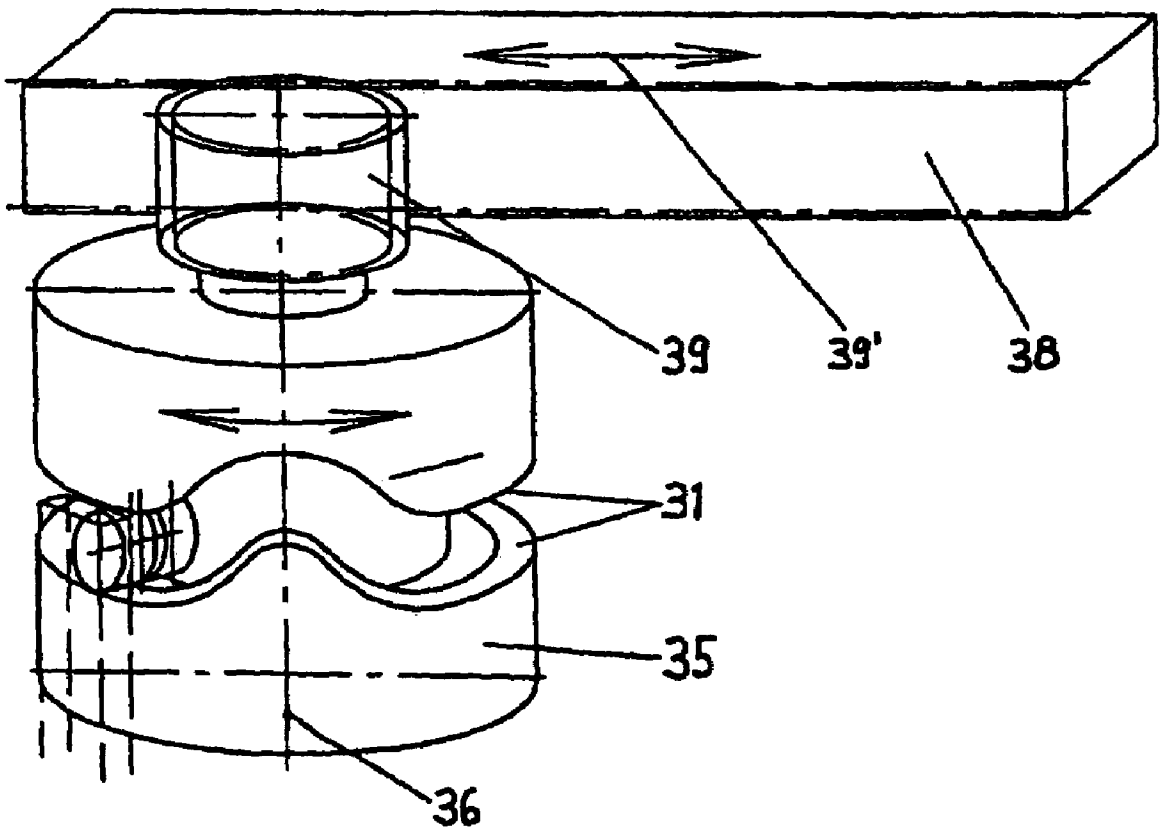
Figure 9:
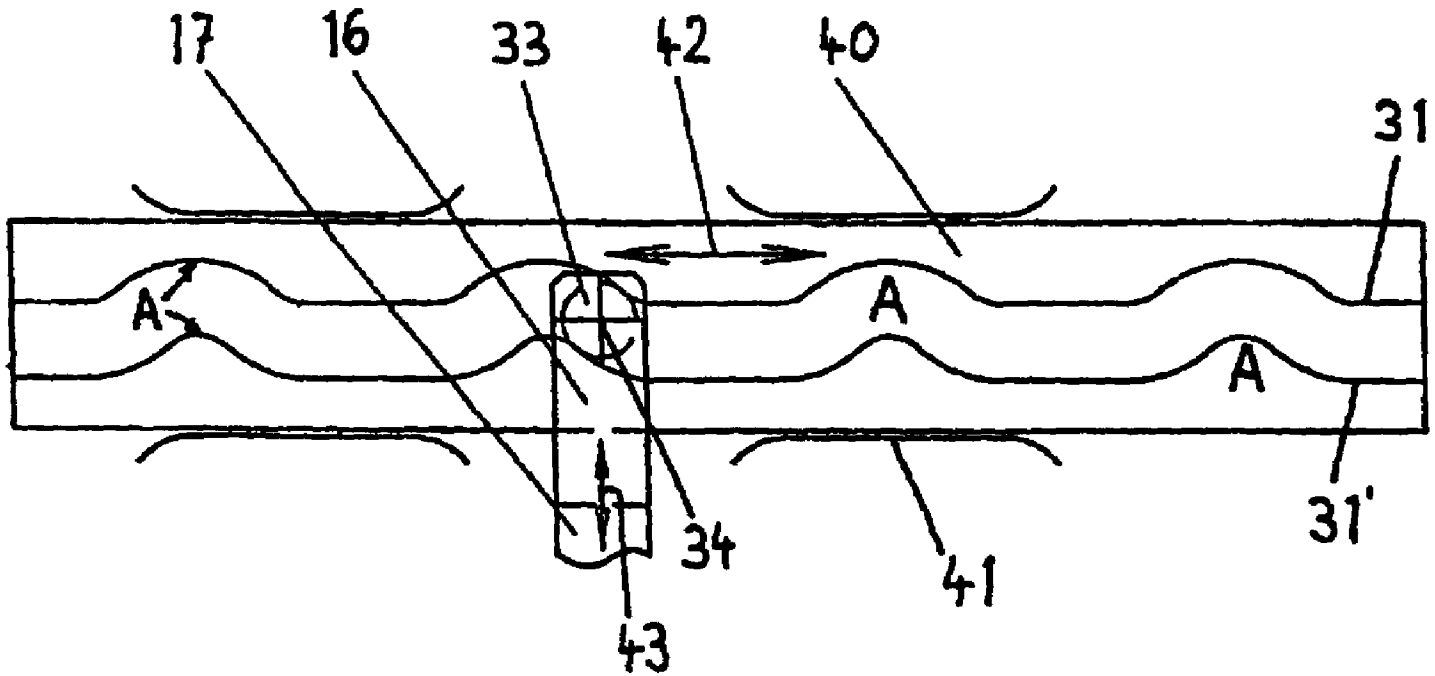
Figure 10:
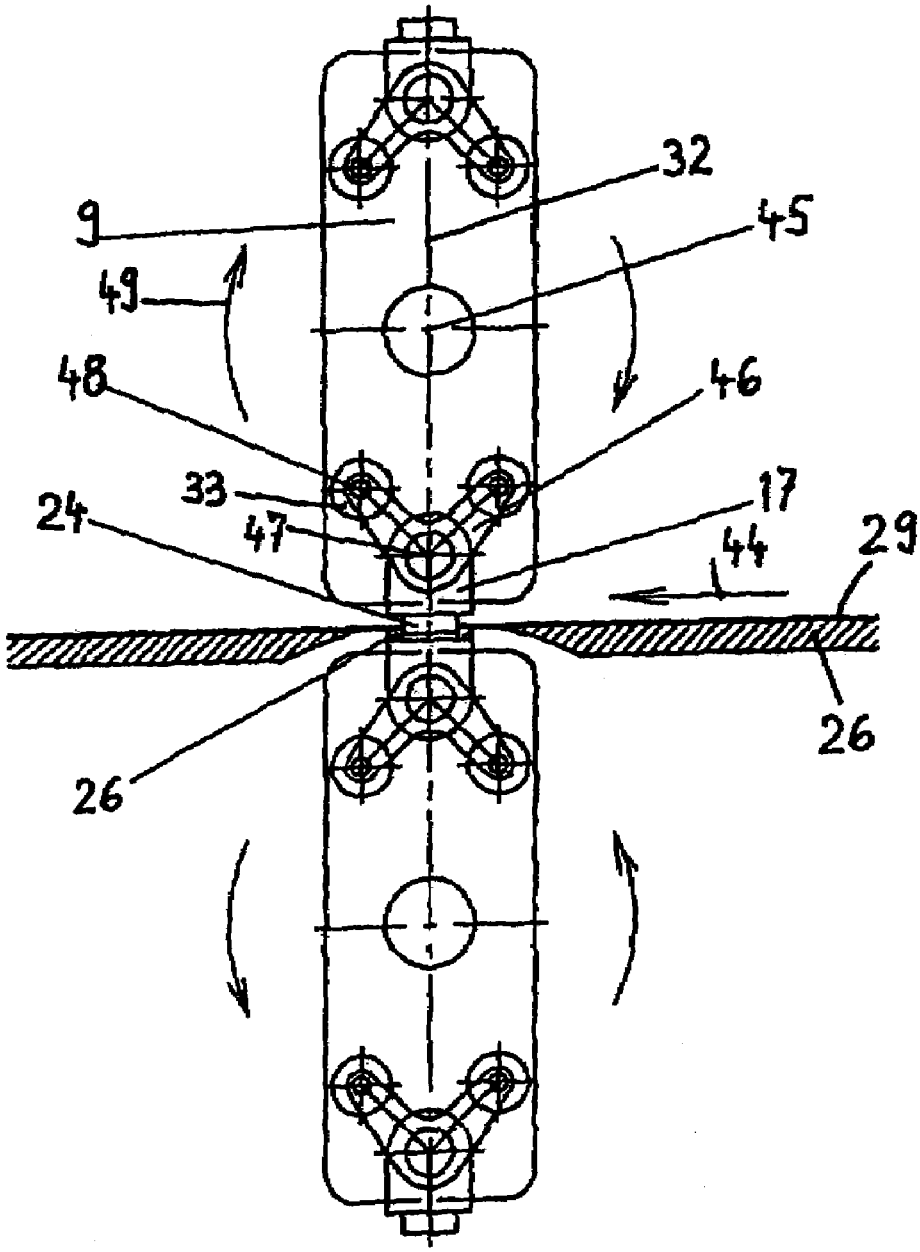

Further advantages, features and possible uses of the present invention will be apparent from the description hereinafter of preferred embodiments, with reference to the accompanying drawings in which:

FIG. 1 shows a first embodiment with a long rotary lever and a short pivot lever which are connected together by way of an elbow lever joint, in a first or rest position (starting position), FIG. 2 shows the same embodiment as in FIG. 1 but with the tool punch in the illustrated lowest position (working position), FIG. 3 shows the same embodiment as in FIGS. 1 and 2 but in the extended position of the drive, in which the tool punch with base plate has been retracted into its rest position again, but with the reversed pivotal angle of the rotary lever in comparison with FIG. 1, FIG. 4 shows a second embodiment in which the cam is provided on the rotary lever in a first rest position of the base plate similarly to FIG. 1 in the other embodiment, FIG. 5 shows the same embodiment as FIG. 4, but with the base plate having moved into the working position, FIG. 6 shows a similar position for the rotary lever (as in FIG. 3 of the first embodiment), here for the second embodiment, with the base plate here again having been retracted into the rest position, FIG. 7 shows a third embodiment in which the roller mounted on the base plate (not shown) runs against a cam which is passed along the periphery of a cylinder (cam cylinder), in the left-hand view as an isometric reproduction of the cam cylinder, and in the right-hand view as a side view partly in cross-section in the region of the rollers, FIG. 8 is an isometric view of a fourth embodiment with a cam cylinder with a pinion fitted thereon, which is guided against a rack, FIG. 9 shows a fifth embodiment with a rectilinear cam bar which is movable with an oscillating translatory movement and which has a cam groove with a plurality of raised locations, and FIG. 10 shows a sixth embodiment of the apparatus according to the invention in which a rotary lever which is rotatable about a horizontal axis and which has movably mounted tools is arranged above a strip which moves with a translatory movement, while in mirror image relationship below the plane of the flat strip a second rotary lever is movable in the same manner, in which respect it will be noted however that it has a support portion of a complementary configuration to the tool punch, in the form of a counterpart holding member.

The embodiments of the apparatus according to the invention, which are illustrated in the drawings, are described and illustrated for the sake of better understanding of the invention by reference to a punching operation as the working procedure. In this case a strip of metal which is guided with a straight translatory movement on a support is selected and described, as constituting the flat element. That does not express limitation of the invention to this type of flat element to be worked.

The first embodiment of the invention, here an apparatus for punching a metal strip which is passing through the apparatus horizontally, is shown in FIGS. 1 through 3. A holder 2 for a cylinder pivot mounting 3 is fixed on a base body 1 of the punching apparatus. A pneumatic cylinder 4 which is selected here as a drive is mounted on the base body 1 by way of the cylinder pivot mounting. A piston rod 5 is fixed linearly movably in the pneumatic cylinder 4 in such a way that mounted to the free end of the piston rod 5 is a fork head 6 which, depending on the respective way in which the pneumatic cylinder 4 is controlled, is movable in the outward direction 7 (arrow) or the inward direction 8 (arrow). A long rotary lever 9 is pivotably connected to an upper mounting 10 of the rotary lever 9. The long rotary lever 9 can be pivoted about its pivot point 11 fixed to the base body 1, by means of the drive 4, 5. An opening 12 is provided in the base body 1 for that pivotal movement.

At its end of the long rotary lever 9, which is opposite to the upper mounting 10, the long rotary lever 9 has an elbow lever joint 13 to which a short pivot lever 14 is pivotably connected. The short pivot lever 14 is rotatably connected by way of its lower elbow lever mounting 15 provided at the other end of the pivot lever 14, to a holder 16 which is mounted fixedly to a base plate 17.

The main plane of that base plate 17 is disposed horizontally and is therefore at a spacing from and parallel to a table 18 which is also fixed to the base body 1. While however the latter is stationary, the base plate 17 can be moved with a translatory movement upwardly in the upward direction 19 or the downward direction 20. That movement is implemented by the drive having the pneumatic cylinder 4 and the piston rod 5. So that the base plate 17 remains parallel to the horizontal plane of the table, there is provided a column guide means 21 whose structure is clearly visible from FIGS. 1 through 3 and which does not need to be further described here, for a column guide means is known per se and is not subject-matter of this invention. While the holder 16 is mounted to the top side of the base plate 17, disposed on the opposite lower side thereof is a holding portion 22 for a tool punch 24 which is biased resiliently outwardly by a compression spring 23. The tool punch 24 is therefore movable relative to the base plate 17 in the upward direction 19 or the downward direction 20 respectively. The longitudinal center line of the tool punch 24 is in the same direction and is identified as the axis 25 of the tool punch 24. In this embodiment the elbow lever mounting 15 and the pivot point 11 are also disposed upwardly on that axis. That affords the possibility of elbow lever dynamics, as will be described hereinafter with reference to FIGS. 2 and 3.

Fixed on the table 18 is a plate-like support 26, in which there is centrally disposed a hole 27 having ground upper edges 28, the dimension of which is precisely matched to the outside edge of the tool punch 24 in per se known manner.

The metal strip 29 is only diagrammatically indicated above the support 26, the strip 29 being disposed between the support 26 and the tool punch 24.

FIG. 1 shows the rest position I of the base plate 17, in which the tool punch 24 is at a sufficient spacing above the metal strip 29, without being in engagement therewith. When the drive moves the piston rod 5 in the outward direction 7, the long rotary lever 9 is moved out of the position shown in FIG. 1 into the working position shown in FIG. 2. Due to the elbow lever dynamics involved, the arrangement firstly involves a longitudinal movement of the holder 16 with the base plate 17 in the downward direction 20 (punching direction), quickly and without a pressure build-up. As soon as the tool punch 24 comes into contact with the metal strip 29, the elbow lever joint 13 is in the dead center point region. In other words, the movement of the long rotary lever 9, shortly before the working position 11, in that position and shortly thereafter, causes an only still slight stroke movement with a very high force. In the case of the embodiment shown in FIG. 2, the working operation is a punching-out operation, and the hole disk 30 which has been punched out is diagrammatically shown here. When the piston rod 5 is moved further in the outward direction 7, the long rotary lever 9 rotates further about its pivot point 11 in the counter-clockwise direction and moves into the position III in FIG. 3. As a result, the base plate 17 was moved upwardly out of the support 26. Two punching operations can be carried out with a to and fro stroke movement of the piston rod 5.

In the second embodiment shown in FIGS. 4 through 6, mounted rotatably to the holder 16 of the base plate 17 is at least one roller 33 which is guided in such a way as to run against a cam 31 provided on the rotary lever 9.

Upon initial extension of the piston 5, in this second embodiment, similarly to FIG. 1, the rotary lever 9 also rotates in the counter-clockwise direction and, by way of the roller 33, moves the base plate 17 downwardly in the direction towards the working position shown in FIG. 5, this taking place firstly quickly and without any counteracting pressure. As soon as the tool punch 24 comes into contact with the metal strip 29, the pivot pin of the elbow lever mounting 15 is again disposed in the dead center point region. The movement of the rotary lever 9 about the pivot point 11 and thus the movement of the cam 31, just before the lower point of the working position and shortly thereafter, by means of the roller 33, produce a short stroke movement in the downward direction 20 (punching direction), although through the small angle prior to the dead center point (and after same respectively) with a high level of force.

FIG. 5, similarly to FIG. 2, shows the position of the rotary lever 9 which has moved the tool punch 24 to the lower dead center point. Shown to the left of that Figure is a detail section through the rotary lever 9 in the form of a cam disk. The lever 9 carries in a milled-out opening in the lever 9 by way of a lower pin 34 on the one hand at the center the holder 16 which is shown in broken-way form and on the other hand on the outside at each side the respective rollers 33 and 33'. That ensures play-free guidance in a vertical direction at top and bottom. In addition the movement can be transmitted without play in the downward direction 20 and the upward direction 19 respectively.

Similarly to FIG. 3 of the first embodiment, FIG. 6 in relation to this second embodiment shows the position III of the base plate 17 when the rotary lever 9 is deflected by a pivotal movement furthest in the counter-clockwise direction about the stationary pivot point 11, that is to say the piston rod 5 is in its most extended position. That caused the base plate to be moved upwardly out of the support 26 again. When the piston rod 5 is moved in the inward direction 8 again by the drive of the pneumatic cylinder 4, then pivotal movement of the rotary lever 9 takes place in the clockwise direction, with renewed downward movement of the base plate 17, with a punching operation and retraction into the initial rest position I of the base plate 17. Once again therefore two punching operations can be carried out with a to and fro stroke movement.

The left-hand illustration in FIG. 7 is an isometric view of a third embodiment while the right-hand illustration in FIG. 7 is a side view of the third embodiment, partly in section. The right-hand side view shows the holder 16 of the base plate 17 in broken-away fashion downwardly in the form of a fork. Rollers 33 and 33' are again mounted rotatably on pins 34, on the holder 16. Those rollers 33, 33' run in a cam cylinder 35. A double cam 31, 31' is milled in groove form in the periphery of the cam cylinder 35 approximately in the central region of its axis 36. The rollers 33, 33' just fit into that groove. At the location identified by A the cams 31, 31' are of a configuration with a component parallel to the axis 25 of the tool punch 24, that axis extending parallel to the axis 36. When the rollers 33 are rotated along the periphery of the cam cylinder 35 which is held in a stationary condition, then the pin 34 of the rollers 33 moves substantially along a horizontal plane which is to be envisaged as being perpendicular to the axis 36. At each location A in contrast the pin 34 moves out of that plane, in accordance with a component in the direction of the axis 36 and therewith also the axis 25 of the tool punch 24, so that the similar movement is ensured in the upward direction 19 and the downward direction 20 respectively for the working procedure by means of the tool punch 24. It will be appreciated that in practice the situation will be such that the cam cylinder 35 is rotated about the axis 36 in the peripheral direction 37, while the pin 34 with the holder 16 and the base plate 17 can be moved only in the upward direction (19) and the downward direction (20) respectively.

To produce the rotary movement of the cam cylinder 35 in the peripheral direction 37, the axis of the drive which is not shown in greater detail in FIGS. 7 through 10 can extend either perpendicularly to or parallel to the axis 36. Preferably the drive is a servo motor.

The configuration of the cam 31 (and also 31') is so selected that the tool punch 24 can be moved very rapidly towards the metal strip 29 by the steep location A with a directional component in parallel relationship with the axis 25 of the tool punch 24. At the apex of that location A the cam 31 (or 31') becomes progressively flatter, similarly to an inclined plane, so that, with a short punching travel movement in the downward direction 20, it is possible to act with a high force on the material, for example the metal strip 29. It will be appreciated that, in this embodiment like also in the other embodiments, the flat element, here the metal strip 29, can either be stationary or it can be moved at an intermittent speed on the support 26 past the tool punch 24. In the working position even a moved strip is stopped and started moving again after the working operation.

FIG. 8 shows a fourth embodiment in which the cam cylinder 35 is of a similar structure and driven in a similar manner. Instead of a servo motor however the rotary drive for the cam cylinder 35, as shown in FIG. 8, is implemented by way of a reciprocated rack 38 whose translatory reciprocating movement is indicated by the double-headed arrow at 39. That rack 38 meshes with a pinion 39 which is fixed on the shaft 36 of the cam cylinder 35. A hydraulic or pneumatic pressure-producing means can act as a drive on the rack 38. The other functions take place in a similar manner to FIG. 7.

FIG. 9 shows a further fifth embodiment of a drive in which a pressure-producing means of any kind acts on the cam bar 40 shown in FIG. 9. Reference 41 indicates plain bearings which provide for precise and easy support for the reciprocating movement as indicated by the double-headed arrow 42. A respective pair of cams 31, 31' in groove form is milled in the cam bar 40 on at least one side thereof but preferably on both (opposite) sides thereof, so that once again this gives a cam configuration having a plurality of locations A at which the respective cam extends with a component parallel to the axis 25 of the tool punch 24 (not shown here). That axis 25 passes through the holder 16 and perpendicularly through the pin 34 of the roller 33 (of the pair thereof). Therefore the double-headed arrow shown in FIG. 9 also lies on the axis 25 of the tool punch 24 or parallel thereto. If the holder 16 is held fast in the translatory direction 42 in accordance with the double-headed arrow illustrated in FIG. 9, preferably in a plane which is to be envisaged as being horizontal, and if the holder 16 is allowed only a translatory upward and downward movement as indicated by the arrow 43 for an upward direction 19 and a downward direction 20, then the movement of the cam bar 40 in the direction of the double-headed arrow 42 produces a linear upward and downward movement of the holder 16 in the direction of the double-headed arrow 43. The locations A with the cam configuration which has already been referred to on a number of occasions hereinbefore are of such a configuration and provide such a cam configuration that, upon movement of the cam bar, for example towards the right in the direction of the arrow 42, the tool punch is moved rapidly towards the metal strip 29 by the steep cam configuration and then the working operation, for example the punching operation, can be executed by the shallower cam configuration at the reversal point (location A) of the cam, with a very large amount of force.

The drive for the cam bar in the direction of the double-headed arrow 42 can again be afforded by different motors, cylinders and the like.

Finally, FIG. 10 shows a sixth embodiment of the apparatus according to the invention for the specific working of a punching by means of the tool punch 24 in co-operating relationship with the support 26 acting as a counterpart holder. A metal strip 29 rests on a support 26 which is interrupted in the working station and which has a flat horizontal surface, the metal strip 29 being moved with an intermittent movement in the conveying direction 44 (from right to left in FIG. 10). Whenever the metal strip 29 is at a standstill the location of the strip which is to be worked upon is in the working position and is under the tool punch 24 or above the annular support 26. The support 26 is an annular tool which is ground at least at the inside edge and on top and acts as a counterpart holder in relation to the tool punch 24. The latter can be moved with a translatory movement towards the metal strip 29 in the direction of the longitudinal center line 32 of the rotary lever 9 which is disposed vertically in the working position as shown in FIG. 10, the punch can pierce the metal strip 29 and can pass therethrough into the circular opening in the interior of the annular support 26 in such a way that, in the punching operation, the punched-out hole disk 30 can drop out downwardly.

The upper rotary lever 9 is rotatable about an axis 45 which is also horizontal and which extends perpendicularly to the conveying direction 44 of the metal strip 29. In the plan view in FIG. 1 the rotary lever 9 is seen to be rectangular with rounded corners and, at each of its two ends which project radially outwardly relative to the axis 45, it carries a respective double-armed lever 46 fixedly connected to the base plate 17 acting as a tool holder. The double-armed lever 46 and the base plate 17 are pivotable about a pivot axis 47 and are also linearly movable in the direction of the longitudinal center line 32. The pivot axis extends parallel to the axis of rotation 45 of the rotary lever 9 and is on the longitudinal center line 32 of the rotary lever 9. The parts which are movable with a translatory and rotational movement relative to the rotary lever 9, namely the double-armed lever 46 and the base plate 17, are guided and thereby controlled, by a cam which is milled groove-like stationarily preferably on the base body. In the plan view in FIG. 10 the double-armed lever 46 is V-shaped and the rollers 33 are rotatably mounted by way of spindles 48 to the free ends of the levers which extend in a V-shaped divergent configuration, the rollers 33 travelling against the above-mentioned cam and being controlled thereby.

The direction of rotation of the rotary lever 9 is indicated by the two curved arrows 49 so that it can be easily imagined that the left-hand roller 33 on the double-armed lever 46 is the roller which is the leading roller in the direction of travel and is the first one to pass into the stationary control cam when the rotary lever 9 moves from an inclined position, before it has reached the position shown in FIG. 10, into the working position.

Once again the tool punch in that way moves at a high rotary speed over a long travel distance into the position shown in FIG. 10. Shortly before that position is reached, the travel speed of the rotating lever 9 and the speed of conveying movement of the metal strip 29 in the direction 44 are equal. In addition, the end front face of the tool punch 24, shortly before the working position is reached, is held in precisely parallel relationship with the flat surface of the metal strip 29. The base plate 17 with the tool punch 24 can then be moved with a translatory movement downwardly towards the support 26 in the direction of the longitudinal center line 32, over a short travel distance and with a high build-up of pressure, in order to carry out the working operation (for example the punching operation). In the punching region the end faces of the tool punch 24 are held in absolutely parallel relationship with the strip 29.

Also arranged on the side in opposite relationship to the upper rotary lever 9 is such a rotary lever which is rotatable about an axis corresponding to the axis 45. The conditions in regard to movements and control configurations are in mirror image the same as for the upper rotary lever 9 as described hereinbefore. The only difference is that the lower base plate has the above-mentioned support 26 so that the tool punch 24 can be urged linearly into the hole in the support 26 and can be retracted therefrom again linearly in the opposite direction.

As soon as the base plate 17 has been drawn out of the support (translatory movement in a direction towards the axes 45), the double-armed levers 46 leave the cams and can then be further moved without guidance.

In the embodiment illustrated in FIG. 10 two tool punches are arranged on sides which are in diametrally opposite relationship with respect to the axis 45. The rotary lever however can also be designed for more tools, for example four, six, or also three and five tool punches with base plate.

LIST OF REFERENCES

| | |
|---|---|
| 1 | base body |
| 2 | holder |
| 3 | cylinder pivot mounting |
| 4 | pneumatic cylinder |
| 5 | piston rod |
| 6 | fork head |
| 7 | outward direction (arrow) |
| 8 | inward direction (arrow) |
| 9 | long rotary lever |
| 10 | upper mounting of the rotary lever |
| 11 | pivot point |
| 12 | opening |
| 13 | elbow lever joint |
| 14 | short pivot lever |
| 15 | elbow lever mounting |
| 16 | holder |
| 17 | base plate |
| 18 | table |
| 19 | upward direction |
| 20 | downward direction |
| 21 | column guide means |
| 22 | holding portion |
| 23 | compression spring |
| 24 | tool punch |
| 25 | axis of the tool punch |
| 26 | support |
| 27 | hole |
| 28 | upper edges of the support |
| 29 | metal strip |
| 30 | hole disk |
| 31, 31' | cam |
| 32 | longitudinal center line of the rotary lever 9 |
| 33, 33' | roller |
| 34 | pin |
| 35 | cam cylinder |
| 36 | axis |
| 37 | peripheral direction |
| 38 | rack |
| 39 | pinion |
| 40 | cam bar |
| 41 | plain bearing |
| 42 | direction of movement of the plain bearings (double-headed arrow) |
| 43 | translatory upward and downward movement (double-headed arrow) |
| 44 | conveying direction |
| 45 | horizontal axis |
| 46 | double-armed lever |
| 47 | pivot axis |
| 48 | spindle |
| A | reversal point of the cam |
| I | rest position |
| II | working position |
| III | rest position |

The invention claimed is:

1. An apparatus for punching, stamping and/or shaping flat elements (29) comprising a base body (1) with a table (18) and a support (26) for the flat element (29), and a base plate (17) which supports a tool punch (24) and which to carry out the working process, can be moved by means of a drive (4, 5), towards the support (26) into a working station (II) for engagement of the tool punch (24) with the support (26) and away from the support (26), characterised in that coupled between the drive (4, 5) and the base plate (17) are transmission means (9, 7; 35; 43; 46) having at least one long rotary lever (9) which is pivotable about a stationery pivot point (11, 45) fixed to the base body, which rotary lever (9) moves the base plate (17) from a rest position (I) in which the tool punch (24) is out of engagement with the support (26), without a pressure build-up, to shortly before the working position (II), and then over a short distance while producing a high pressure between the base plate (17) and the flat element (29) into the working positions (III) and upon further activity of the drive (4, 5) move the base plate (17) into the rest position (I, III) again in the reverse direction of movement, wherein at its one end the long rotary lever (9) is coupled by way of an elbow lever joint (13) to an end of a short pivotal lever (7) whose other end is coupled to the base plate (17) by way of an elbow lever bearing (15) and wherein the long rotary lever (9) is longer than the short pivotal lever (14), characterized in that the drive (4, 5) is mounted to the other end of the long rotary lever (9) in such a way that the drive (4, 5) is disposed axially outside from the pivot point (11).

2. Apparatus as set forth in claim 1 characterised in that the axis (5; 45) of the drive (4, 5) is perpendicular to the axis of the tool punch (24).

3. Apparatus as set forth in one of claims 1-2 characterized in that there exists an operational two-way connection between the drive (4, 5) and said other end of said lever (9).

4. Apparatus as set forth in one of claims 1-2 characterised in that the linear direction of movement (19, 20) of the base plate (17) is predetermined by a column guide means (21) operative between the base body (1) and the base plate (17) and that the drive (4, 5) has a drive means (5) oscillating linearly on the axis of said drive.

5. Apparatus as set forth in one of claims 1-2 characterised in that a long rotary lever (9) is pivotable about a pivot point (11) fixed to the base body (1) and is coupled at its one end by way of an elbow lever pivot (13) to one end of a short pivot lever (14) whose other end is coupled to the base plate (17) by way of an elbow lever mounting (15).

* * * * *

UNITED STATES PATENT AND TRADEMARK OFFICE

CERTIFICATE OF CORRECTION

PATENT NO. : 7,353,685 B2
APPLICATION NO. : 10/524483
DATED : April 8, 2008
INVENTOR(S) : Peter Josef Martin et al.

It is certified that error appears in the above-identified patent and that said Letters Patent is hereby corrected as shown below:

Column 7, line 17, replace “working position 11” with --working position II--.

Signed and Sealed this

First Day of July, 2008

JON W. DUDAS
*Director of the United States Patent and Trademark Office*